United States Patent [19]

Otsuka et al.

[11] Patent Number: 4,926,552

[45] Date of Patent: May 22, 1990

[54] CUTTING HEAD FOR RECIPROCATORY-TYPE DRY SHAVERS

[75] Inventors: Kiyotaka Otsuka; Hideji Wataya, both of Hikone, Japan

[73] Assignee: Matsushita Electric Works, Ltd., Japan

[21] Appl. No.: 292,015

[22] Filed: Dec. 30, 1988

[30] Foreign Application Priority Data

Jan. 26, 1988 [JP] Japan ..... 63-15065

[51] Int. Cl.[5] ..... B26B 19/02

[52] U.S. Cl. ..... 30/43.92; 30/346.51

[58] Field of Search ..... 30/43, 43.91, 43.92, 30/346.51

[56] References Cited

U.S. PATENT DOCUMENTS

| | | | |
|---|---|---|---|
| 3,815,232 | 6/1974 | Liska | 30/346.51 |
| 3,824,687 | 7/1974 | Baumann | 30/43.92 |
| 4,035,914 | 7/1977 | Blume et al. | 30/346.51 |
| 4,660,283 | 4/1987 | Yasunaka . | |
| 4,719,698 | 1/1988 | Ninomiya et al. | 30/43.92 X |
| 4,726,116 | 2/1988 | Schweinaruber et al. | 30/43.92 |

FOREIGN PATENT DOCUMENTS

| | | |
|---|---|---|
| 0115061 | 8/1984 | European Pat. Off. . |
| 623267 | 12/1969 | Fed. Rep. of Germany . |
| 1553639 | 7/1970 | Fed. Rep. of Germany . |
| 2405462 | 8/1974 | Fed. Rep. of Germany . |
| 53-40300 | 9/1978 | Japan . |
| 902248 | 8/1962 | United Kingdom . |
| 1161757 | 8/1969 | United Kingdom . |
| 1184672 | 3/1970 | United Kingdom . |
| 1394933 | 5/1975 | United Kingdom . |
| 1435456 | 5/1976 | United Kingdom . |
| 1486038 | 9/1977 | United Kingdom . |
| 1533679 | 11/1978 | United Kingdom . |
| 2032324 | 5/1980 | United Kingdom . |

OTHER PUBLICATIONS

Beilage Suddeutsche Zeitung vom 10. Dec. 1987.

German Patent Office Search Report dated 24 May 1989.

British Search Report by Examiner A. Timothy of 23 Mar. 1989.

*Primary Examiner*—Douglas D. Watts

*Attorney, Agent, or Firm*—Stevens, Davis, Miller & Mosher

[57] ABSTRACT

A cutting head for reciprocatory-type shavers comprises a mount frame carrying a shearing foil and an inner cutter driven to reciprocate in shearing contact with the shearing foil. The mount frame has a pair of opposed side bars between which the shearing foil extends in a convexly shaped manner to have its longitudinal axis extending along the apex of the shearing foil and in parallel with the side bars. The inner cutter is driven to reciprocate along the longitudinal axis and is mounted to be movable to a limited extent laterally towards the side bars. The opposite lower end or the lateral end portions of the shearing foil are secured to the outside surfaces the side bars, respectively such that each of the side bars is interposed between the inner cutter and the lower end portion of the shearing foil. Consequently, the portions can be prevented from contacting directly with and scratched or damaged by the inner cutter even when the inner cutter is forced to move laterally towards the side bar together with the shearing foil as a result of the latter being pressed against the skin of the user during the shaving operation.

9 Claims, 10 Drawing Sheets

CUTTING HEAD FOR RECIPROCATORY-TYPE DRY SHAVERS

BACKGROUND OF THE INVENTION

1. Field of the Invention

The present invention is directed to a cutting head for reciprocatory-type shavers, and more particular to the mounting structure of a convexly curved shearing foil on the cutting head.

2. Description of the prior art

Reciprocatory-type shavers include a cutting head in which an outer shearing foil is convexly curved along an arcuate edge of a cooperative inner cutter and is secured at its opposite lower ends to a head frame. Generally, the head frame comprises a pair of opposed side bars between which the inner cutter extends. In the prior cutting heads, the shearing foil is held on the frame in such a manner that the opposite lower end portions of the shearing foil are secured to the inside of the respective side bars, as typically shown in U.S. Pat. No. 4,660,283. Such supporting structure of the shearing foil is found to pose the following problem while the cutting head is manipulated to move across the skin of the user as being pressed against the skin. During this manipulation a deformative force is very likely to act on one side of the shearing foil in the direction perpendicular to the length of the shearing foil. With this consequence, the inner cutter is correspondingly shifted to urge upon the other side of the shearing foil, whereby damaging or at least greatly wearing the portion of the shearing foil.

Further, with the prior structure of securing the lower end portions of the shearing foil to the inside of the frame, the side bars eventually add extra thickness to the lateral dimension of the curved shearing foil, thus leaving the cutting head rather bulky while the shearing foil may be curved into a sharp configuration. Such a bulky cutting head makes it to be difficult to follow a narrow complicated portion of the skin, such as under the chin or around the throat of the user, leaving uncut hairs at that portion.

SUMMARY OF THE INVENTION

In view of the above insufficiencies, the present invention has been accomplished to provide an improved cutting head for reciprocatory shavers. The cutting head in accordance with the present invention comprises a mount frame carrying a shearing foil with a number of hair introducing apertures. The mount frame has a pair of opposed side bars between which the shearing foil bridges in a convexly shaped configuration with its longitudinal axis extending along the apex of the curve in parallel with the side bars. Extending into the space between the side bars is an inner cutter assembly having a number of inner blades driven to reciprocate along the longitudinal axis of the shearing foil in shearing contact therewith for hair shearing. The inner cutter assembly is allowed to be movable to a limited extent within the mount frame transversely towards the side bars. The characterizing feature of the present invention resides in the fact that the shearing foil has its lateral lower end portions secured to the exterior surface of the side bars, respectively such that the lower end portions of the shearing foil is isolated from the inner cutter assembly by the side bars in no direct contactable relation from the inner cutter assembly. Therefore, the lower end portions of the curved shearing foil can be protected from direct contact with the inner cutter assembly when the later is displaced laterally as a result of the shearing foil being pressed inwardly during the shearing operation. In other words, the inner cutter assembly is restricted in its lateral movement by contact with the side bars of the mount frame and not with the shearing foil itself when one side of the shearing foil is pressed by contact with the skin.

Accordingly, it is a primary object of the present invention to provide an improved cutting head for reciprocatory shavers in which the lower end portions of the curved shearing foil can be kept free from being damaged or worn by the cutter assembly even when the cutting head is utilized to be pressed against the skin, enhancing the convenience and effectiveness of manipulating the shaver, yet lengthening the life of the shearing foil.

In a preferred embodiment of the present invention, the mount frame includes a pair of elongated clamp plates each of which is placed over the lower end portion of the shearing foil and fixed onto the exterior surface of the side bar in order to hold therebetween the lower end portion of the shearing foil. Each clamp plate has its top portion extending above the upper end of the adjacent side bar so as to conceal the hair introducing apertures in the limited region adjacent upwardly of the side bar, whereby eliminating the undesired occurrence that the hairs extending through the apertures are accidentally entrapped between the side bar and the shearing foil and are pulled without being sheared while moving the cutting head across the skin.

It is therefore another object of the present invention to provide an improved cutting head for reciprocatory shavers which assures to prevent the hairs from becoming accidentally entrapped between the mount frame and the shearing foil.

Each of the side bars is formed on its exterior with a set of studs which extend through mount holes correspondingly formed in the lower end portions of the shearing foil to retain the shearing foil on the mount frame. Formed in the inner surface of the clamp plate is a groove extending in the length of the clamp plate for receiving therein the studs. The groove is designed to form on the opposite surface a corresponding band of raised rib for reinforcing the clamp plate and therefore assuring the secured mounting of the shearing foil to the mount frame, which is therefore a further object of the present invention.

The cutting head is detachably mounted on the top of a flat-shaped main housing incorporating a source of power for reciprocation of the inner cutter assembly. In one version of the present invention, the cutting head is designed to have the apex or the top end of the shearing foil offset laterally such that one half face of the convexly curved shearing foil is substantially in the same plane of the front face of the main shaver housing on which front face is provided a handle for operation of the shaver. With this angled disposition of the apex of the shearing foil, the user can always orient the apex towards his face and be easily confirmed of its orientation simply by holding the main housing with the thumb on the handle in an intrinsic manner. Thus, it is easy to direct the apex to the particular portions of the skin for close shave thereat.

It is therefore a still further object of the present invention to provide a cutting head for reciprocatory shavers which is convenient for close shaving at the apex of the shearing foil.

In addition, the shearing foil is made to have less rigidity at the apex than at the other portions such that the shearing foil can flex preferentially at the apex. With this result, the shearing foil can readily conform to the arcuate edge of the inner blade without developing unduly high contact pressure therebetween, contributing to substantially reducing the wearing of the shearing foil These and other objects and advantages will become apparent from the following description of the preferred embodiment of the present invention when taken in conjunction with the accompanying drawings.

DESCRIPTION OF THE PREFERRED EMBODIMENTS

First embodiment <FIGS. 1 to 5>

Figure 1:
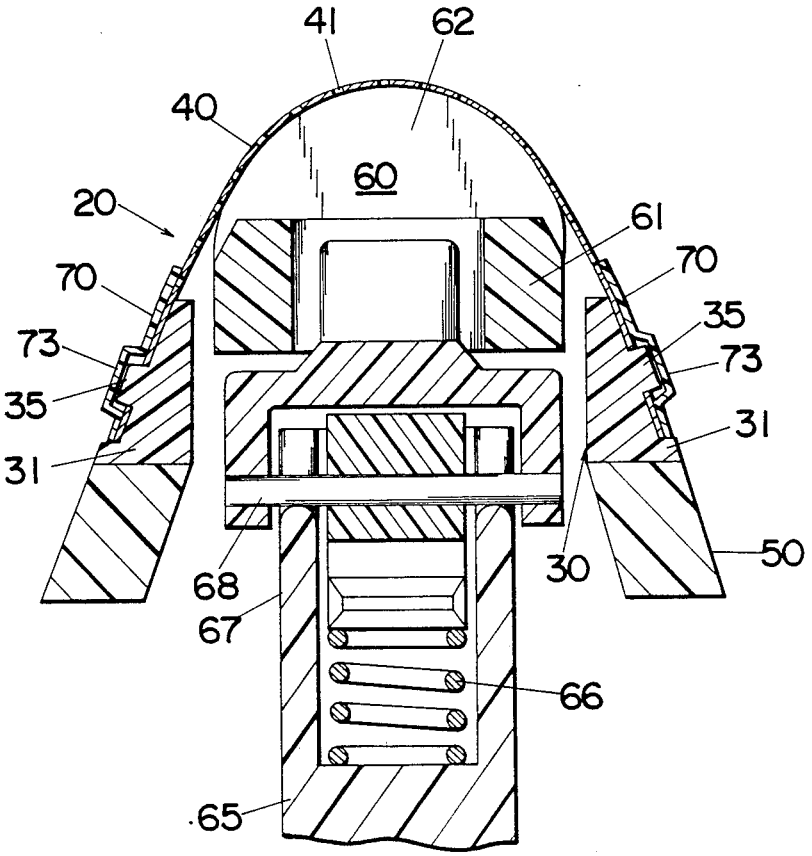
FIG. 1 is a sectional view of a cutting head for reciprocatory shavers in accordance with a first embodiment of the present invention.
Figure 2:
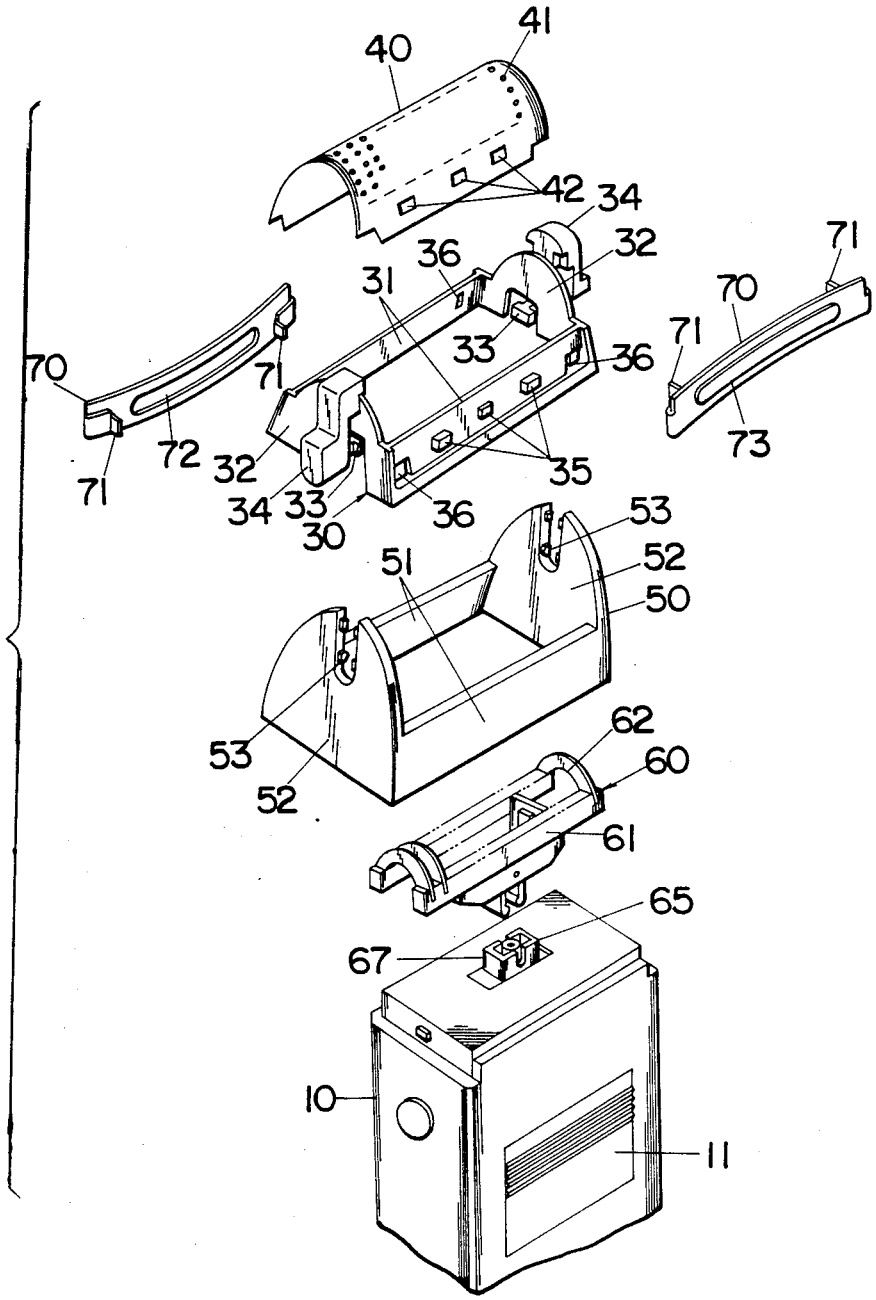
FIG. 2 is a perspective view of the shaver with the cutting head shown in exploded fashion.

Referring now to FIGS. 1 and 2, there is shown a cutting head for reciprocatory type shavers in accordance with a first preferred embodiment of the present invention. The cutting head 20 comprises a mount frame 30 carrying a shearing foil 40 with a number of hair introducing apertures 41. The mount frame 30 is of a rectangular configuration defined by a pair of opposed side bars 31 and a pair of end members 32 bridged by the side bars 31. The mount frame 30 is detachably mounted on an auxiliary frame 50 which is also detachable to the top of a main shaver housing 10 of flat-shape configuration.

An inner cutter assembly 60 is provided on the top of the main housing 10 and is driven by a drive member 65 to reciprocate along its lengthwise direction. Within the housing 10, the drive member 65 is coupled to an electric motor 15 and translates the rotary motion of the motor 15 into the reciprocating movement. A switch handle 11 is slidable on the front face of the housing 10 for energization and deenergization of the motor 15. The inner cutter assembly 60 comprises a base 61 carrying thereon a number of inner blades 62 each having an arcuately curved edge and extends into the mount frame 30 with the inner blade 62 in shearing contact with the under surface of the shearing foil 40, as shown in FIG. 1. For assuring positive shearing contact between the shearing foil 40 and the inner blades 62, the inner cutter assembly 50 is urged upwardly by a compression spring 66 seated in a joint 67 of the drive member 65. As shown in FIG. 1, the inner cutter assembly 60 is coupled to the joint 67 of the drive member 65 by means of a transverse pin 68 so as to follow the reciprocating movement of the drive member 65, while leaving clearances on the lateral sides of the joint 67 so as to allow the inner cutter assembly 60 to move laterally to a limited extent within the frame 30.

The auxiliary frame 50, composed of a pair of opposed side walls 51 and a pair of end walls 52, supports the mount frame 30 in such a manner that the side bars 31 of the mount frame 30 rest on top of the side walls 51, respectively, while the end members 32 are located inside of the end walls 52, respectively. The mount frame 30 is latched to the auxiliary frame 50 with hooks 33 at the end member 32 engaged with corresponding latches 53 in the end walls 52. A release knob 34 is formed on the mount base 30 adjacent the hook 33 for disengagement of the hooks 33 from the latch 53, or detachment of the mount base 30 from the auxiliary frame 50.

Figure 3:
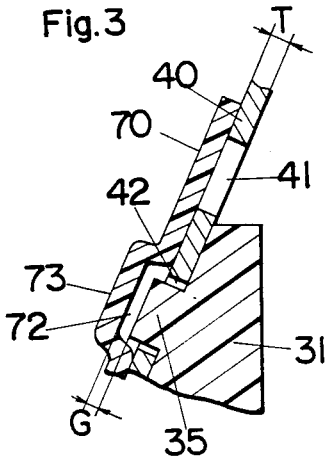
FIG. 3 is an enlarged sectional view of the connection of the sharing foil with a mount frame of the cutting head.

The shearing foil 40 is prepared in the form of a rectangular configuration and is attached to the mount frame 30 in a convexly curved manner between the opposed side bars 31 with the lateral end portions of the shearing foil 40 secured to the exterior of the side bars 31, respectively by the use of clamp plates 70. To this end, each side bar 31 is formed on its exterior with a set of horizontally aligned studs 35 which extend respectively through mount holes 42 formed in the lateral end portions of the shearing foil 40, and is also formed in the lengthwise ends with catch recess 36 for receiving anchor legs 71 at the longitudinal ends of the clamp plate 70. Formed in the inner surface of each clamp plate 70 is a horizontally extending groove 72 in to which the studs 35 extend through the mount holes 42 of the shearing foil 40 and which defines a raised rib 73 on the outer surface of the clamp plate 70 for reinforcement thereof. Each clamp plate 70 is prepared as being somewhat bowed or arcuately warped to have its longitudinal ends deflected outwardly such that when the clamp plate 70 is fitted over the shearing plate 70 on the side bar 31 with its anchor legs 71 snapped into the respective catch recesses 36, it is biased inwardly to thereby grip the shearing foil 40 firmly between the clamp plate 70 and the corresponding side bar 31. In this connection, the outer two studs 35 on each side bar 31 are dimensioned, as shown in FIG. 3, to have such a height as to leave between the bottom of the groove 72 and the top of the stud 35 a gap G less than the thickness T of the shearing foil 40, whereby preventing the shearing foil 40 from slipping away from the studs 31. All the studs 31 including the middle one have the height greater than the thickness of the shearing foil 40.

As shown in FIGS. 1 and 2, each clamp plate 70 has its top portion projecting upwardly along the shearing foil 40 past the upper edge of the adjacent side bar 31 to conceal the hair introducing holes 41 located immediately adjacent the upper edge of the side bar 31, thus preventing accidental trapping of the hairs between the side bar 31 and the shearing foil 40. If such trapping should occur, the hairs would be pulled without being sheared during the manipulation of moving the cutting head across the skin of the user, therefore such hair trapping should be avoided for comfortable hair shaving operation.

Figure 4:
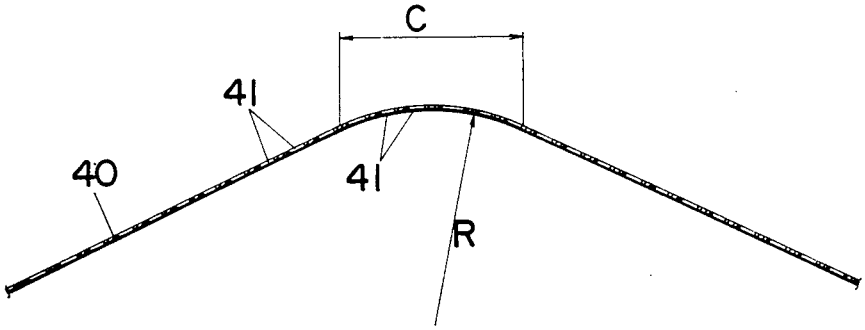
FIG. 4 is a sectional view of the shearing foil.

With the above structure of securing the lower ends of the shearing foil 40 to the exterior of the respective side bars 31 of the mount frame 30, each side bar 31 come between the inner cutter assembly 60 and the lower end portions of the shearing foil 40 so as to prevent the latter from contacting directly with the inner cutter assembly 60 when the inner cutter assembly 60 is displaced laterally as a result of the shearing foil 40 being forced inwardly. Thus, even when the inner cutter assembly 60 is forced to move laterally together with the shearing foil 40, such as in the direction indicated by an arrow in FIG. 1, during the shaving operation of moving the cutting head across the skin of the user, the lower portion or the base 61 of the inner cutter assembly 60 will abut against the side bar 31 on the opposite side, thus leaving the lower end portion of the shearing foil 40 unharmed therefore assuring elongated operational life of the shearing foil 40. It is noted at this time that, as shown in FIG. 4, the shearing foil 40 is originally prepared in a somewhat curved configuration having its center portion C bent upon a relatively small radius R while leaving the other portions rather flat. Further, the center portion C is designed to have less rigidity against bending forces than at other portions, such that the shearing foil 40 can be readily curved to have gradually decreasing radii of successive points from the center or top to the lateral or lower ends when attached to the mount frame 30. Such reduced rigidity is obtained by increasing the density of the holes in the center portion C, by reducing the width of the segment separating the holes 41, or by reducing the thickness at that portion.

Figure 5:
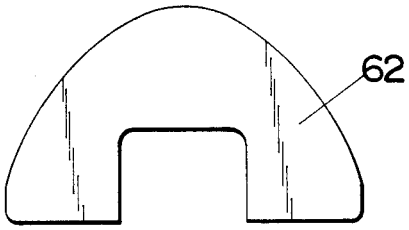
FIG. 5 is an end view of a cutter blade utilized in the cutting head.

As shown in FIG. 5, the inner blades 62 are configured to have monotonic increasing tangents along its edge from the top toward the lateral ends to assume a similar curvature to the shearing foil 40. When the mount frame 30 is attached on the shaver housing 10, the inner blades 62 come into contact firstly with the top end portion C at its corresponding top portion by the upward spring-bias of the spring 66 acting on the inner cutter assembly 60. With this upwardly biasing force acting on the center portion C of less rigidity, the shearing foil 40 is permitted to easily flex inwardly about the center portion C so as to conform exactly to the arcuate edge of the inner blades 62. Conversely, with the provision of reducing the rigidity at the center portion C, the shearing foil 40 can readily conform to the cutting edges of the inner blades 62 only by a minimum biasing force, which contributes to eliminating unduly high contact pressure between the shearing foil 40 and the inner blades 62 and therefore considerably reducing the resistance therebetween and the resulting noises in the shaving operation.

Further, since the shearing foil 40 has a center portion C which has less rigidity as well as less radius of curvature, it can be readily curved into a flat shape with a rather steep apex. This is advantageous for shaving a complicatedly profiled portion of the face such as the portions around the chin or throat. Additionally, the rather flat-shaped cutting head 20 also contributes to reducing the thickness of the overall shaver configuration in cooperation with the above external mounting of the shearing foil 40 to the mount frame 30, as the clamp plate 70 requires only a slight thickness and adds a minimum thickness to the overall dimension of the cutting head 20 and the shaver.

Figure 6:
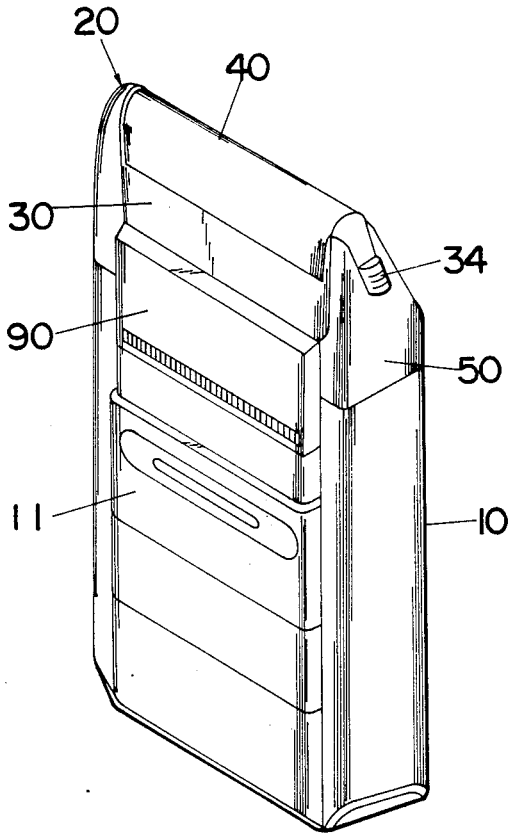
FIG. 6 is a perspective view of another type of a shaver to which the cutting head of the present invention is adapted.
Figure 7:
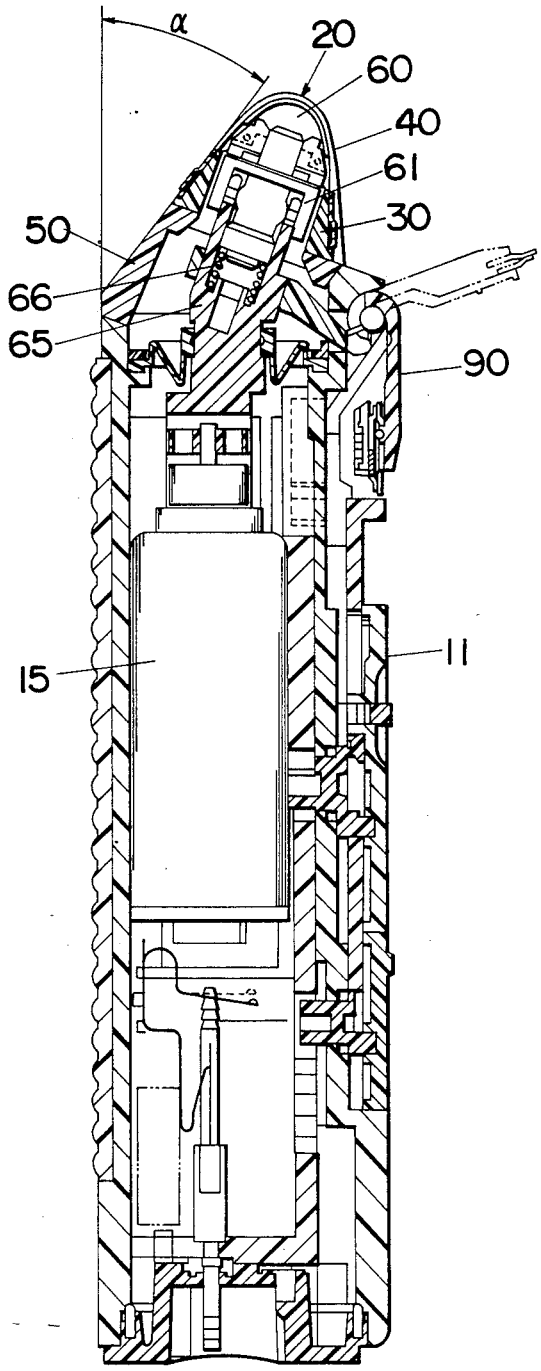
FIG. 7 is a vertical section of the shaver of FIG. 6.

The cutting head 20 of flat-shaped configuration is found to be particularly advantageous when mounted on the main housing 10 in an inclined manner, as shown in FIGS. 6 and 7. In this instance, the cutting head 20 has its apex offset laterally toward the plane of the front face of the main housing 10 such that one half side face of the shearing foil 40 is substantially in the same plane of the front face while the other half side face is inclined at an angle $\alpha$ of about 30° with respect to the general plane of the rear face of the housing 10. Thus, the apex of the cutting head 20 is offset to the front face having the switch handle 11 and is therefore always kept oriented to the face of the user while the housing 10 is grasped by the hand of the user with his thumb placed over the switch handle 11, so that the user can be always confirmed of the apex of the cutting head 20 and assured of a very convenient shaving operation. A trimmer 90 is provided on the upper portion of the front face adjacent the apex of the cutting head 20 so as to be likewise confirmed of its position during the shaving operation. The trimmer 90 is activated also by the operation of the switch handle 11.

Figure 8:
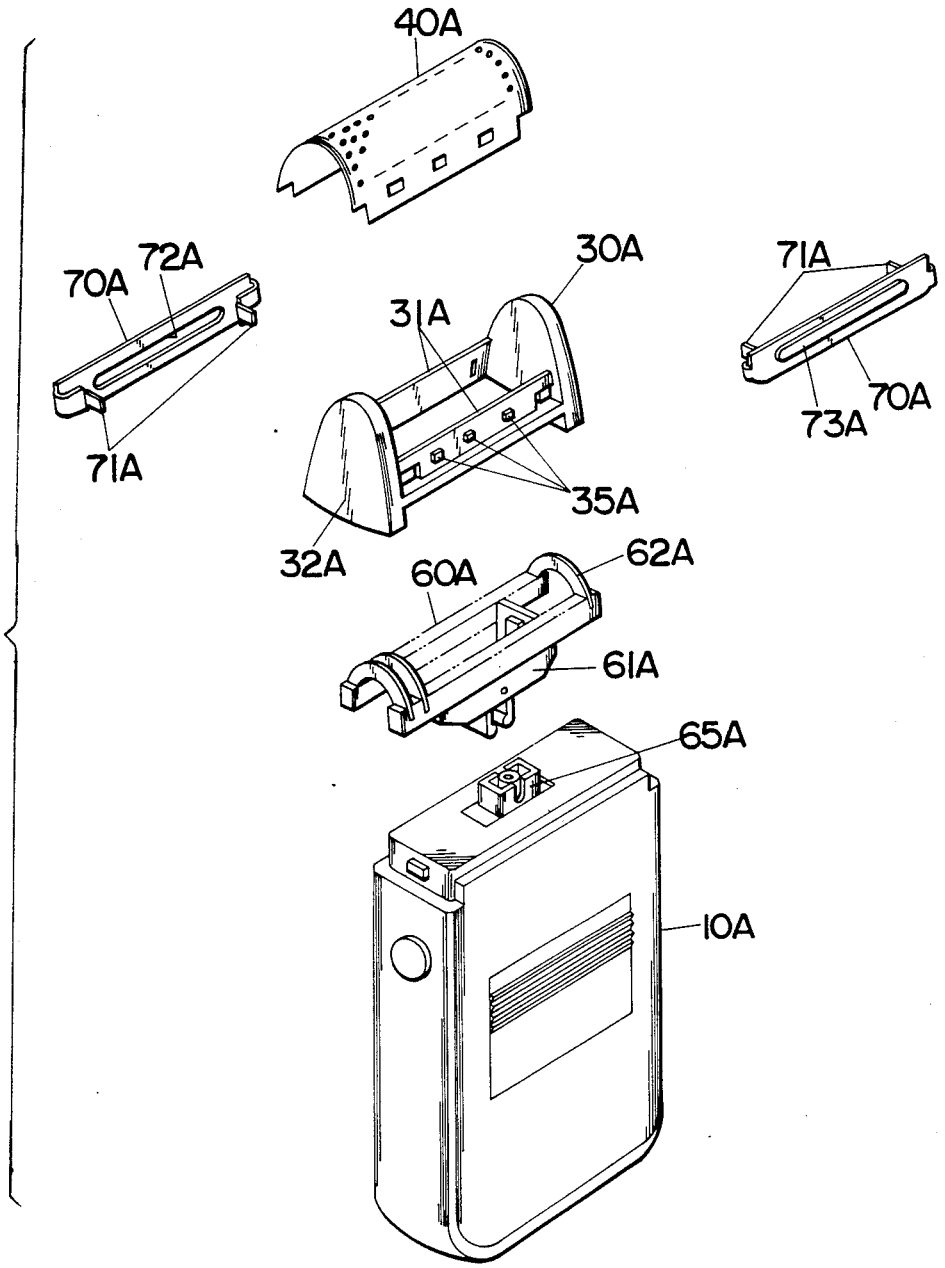
FIG. 8 is an exploded perspective view of a cutting head of a modification of the first embodiment of FIG. 1.

Although the above embodiment and the other embodiments hereinafter described show the mount frame which is demountable to the shaver housing by way of the auxiliary frame, the present invention should not be limited to such construction and may be suitably modified to have the mount frame directly demountable to the shaver housing, as shown in FIG. 8, which is a modification of the first embodiment. In this modification, like parts are designated by the like reference numerals with a suffix letter of A.

Figure 9:
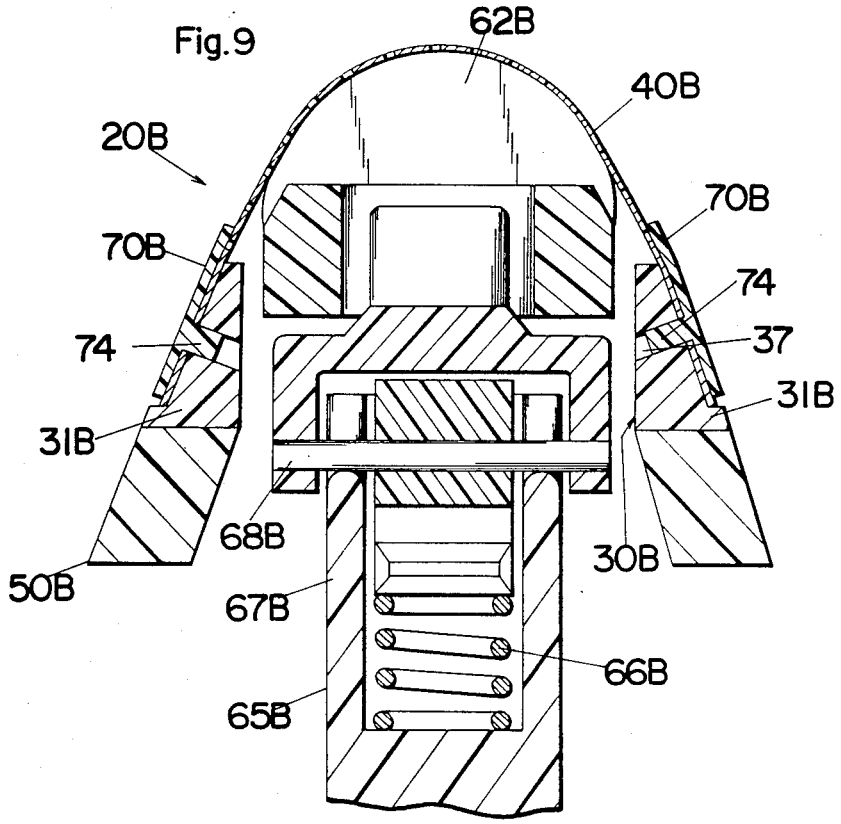
FIG. 9 is a sectional view of a cutting head in accordance with a second embodiment of the present invention.
Figure 10:
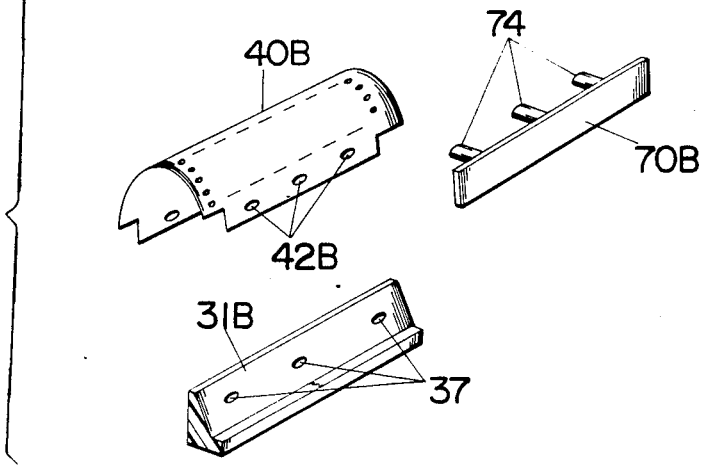
FIG. 10 is an exploded perspective view in schematic representation of the cutting head of FIG. 9.

Second embodiment <FIGS. 9 and 10>

FIGS. 9 and 10 show a cutting head 20B in accordance with a second embodiment of the present invention which is similar to the first embodiment except for the fixing structure of the shearing foil 40B. The other structures are identical to the first embodiment and therefore designated by the like reference numerals. In the second embodiment, a set of studs 74 are formed on a clamp plate 70B rather than on the side bars 31B of a mount frame 30B. The clamp plate 70B is placed over the lower end portion of the shearing plate 40B on each side bar 31B with the studs 74 extending through the mount holes 42B and press-fitted into eyes 37 formed in the side bar 31B. Thus, the shearing foil 40B has its lower end portions respectively held between the clamp plates 70B and the side bars 31B of the frame 30B. As seen in FIG. 9, the upper end of each clamp plate 70B extends beyond the upper end of the adjacent side bar 31B to prevent accidental hair trapping as described in the first embodiment.

Third embodiment <FIGS. 11 to 16>

Figure 11:
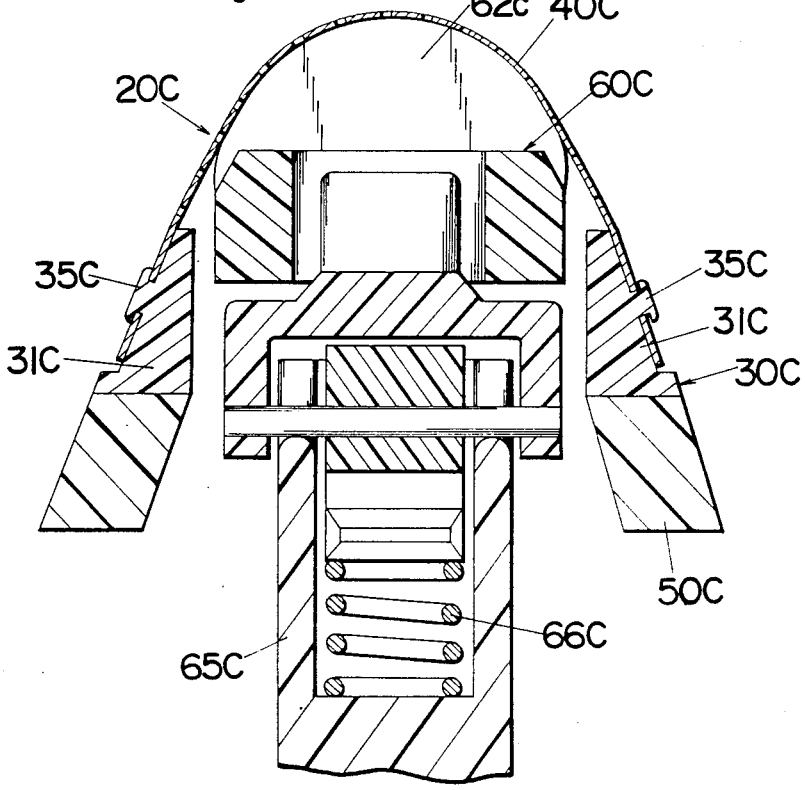
FIG. 11 is a sectional view of a cutting head in accordance with a third embodiment of the present invention.
Figure 12:
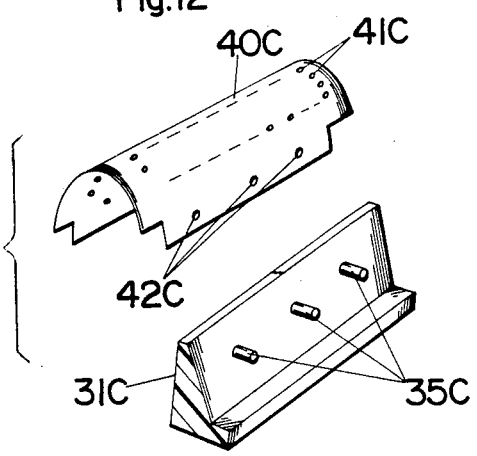
FIG. 12 is an exploded perspective view in schematic representation of the cutting head of FIG. 11.
Figure 13:
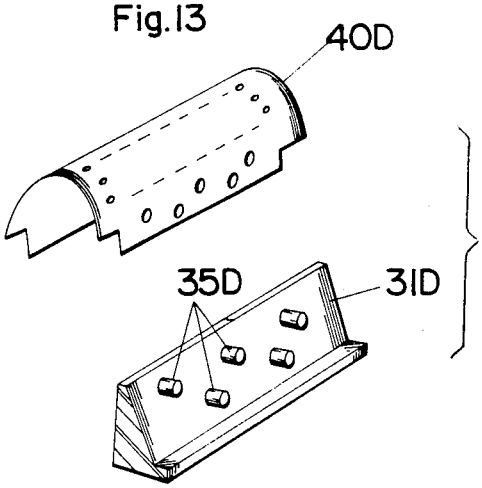
FIG. 13 is an exploded perspective view in schematic representation of a cutting head of a first modification of the third embodiment of FIG. 11.

FIG. 11 shows a cutting head 20C of a third embodiment which is similar to that of the first embodiment except for the securing structure of a shearing foil 40C to a mount frame 30C. The other structures are identical to the first embodiment and are designated by like numerals with a suffix letter of C. As shown in FIG. 12, each side bar 31C has a set of studs 35C which extend through the mount holes 42C of the shearing foil 40C to be head-bonded thereto. Thus, the mount frame 30C can hold the shearing foil 40C without requiring the clamp plates utilized in the first and second embodiments. For obtaining even greater bonding strength, each side bar 31D may have a greater number of studs 35D arrange in two rows in staggered relation, as shown in FIG. 13, which is a first modification of the third embodiment.

Figure 14:
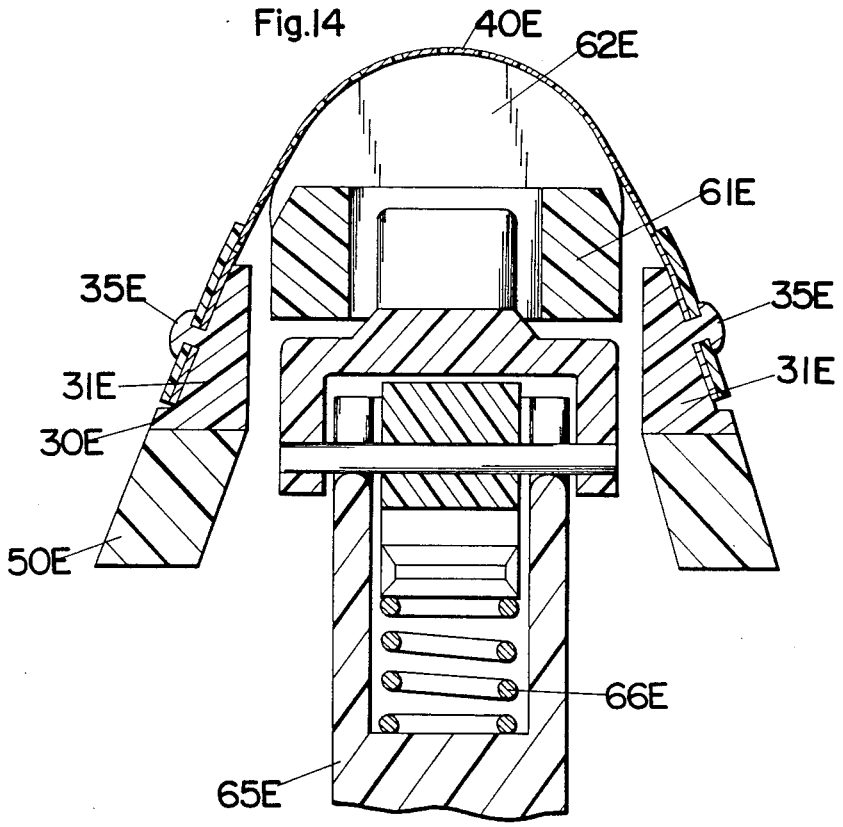
FIG. 14 is a sectional view of a cutting head of a second modification of the third embodiment of FIG. 11.
Figure 15:
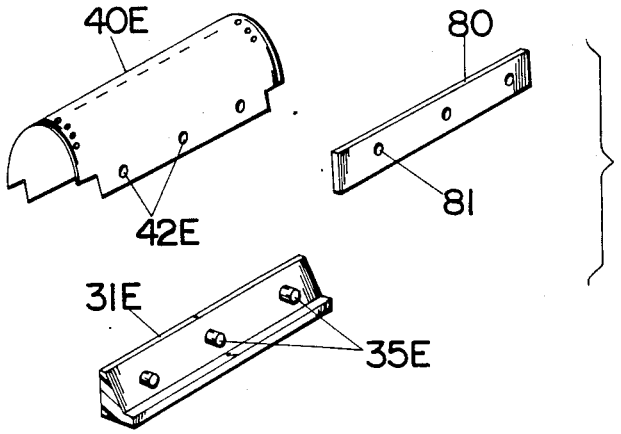
FIG. 15 is an exploded perspective view of the cutting head in schematic representation of FIG. 14.

Alternately, as shown in FIGS. 14 and 15, an additional patch plate 80 may be placed over the shearing foil 40E on each of the side bars 31E and is heat-bonded to the like studs 34E extending through mount holes 42E of the shearing foil 40E and through perforations 81 of the patch plate 80. In this modification, the additional patch plate 80 has its upper end located above the upper end of the adjacent side bar 31E for the same purpose as discussed in the first embodiment.

Figure 16:
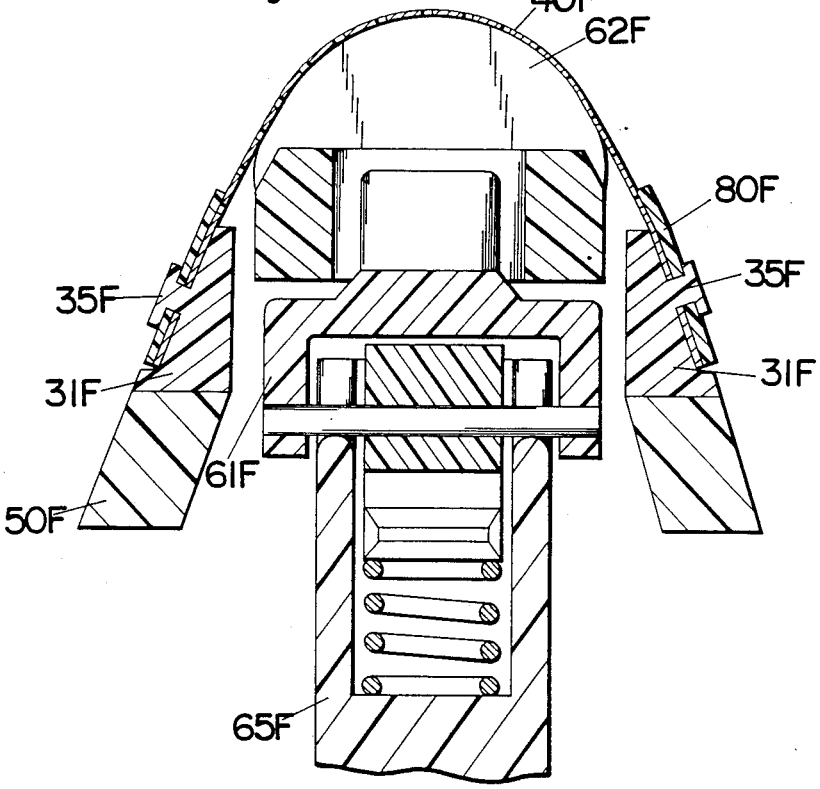
FIG. 16 is a sectional view of a cutting head in accordance with a third modification of the third embodiment of FIG. 11.
Figure 17:
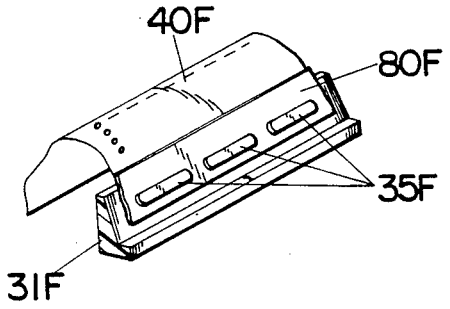
FIG. 17 is an exploded perspective view in schematic representation of the cutting head of FIG. 16.

As shown in FIGS. 16 and 17 which is a further modification of the third embodiment, it may be equally possible to secure the lower end portions of the shearing foil 40F to the exterior of the side bars 31F at the molding of the mount frame 30F by the use of integral studs 35F on each side bar 31F. In this instance, the studs 35F are preferably elongated and a patch plate 80F covering the lower end portion of the shearing foil may be secured together at the molding.

What is claimed is:

1. In a cutting head for reciprocatory-type shavers comprising:

a mount frame having a pair of opposed side bars between which a shearing foil extends in a convexly curved manner, said curved shearing foil having a plurality of hair receiving apertures and having a longitudinal axis extending along its top end in parallel with said side bars;

an inner cutter assembly having a plurality of inner blades which are in shearing contact with the undersurface of said shearing foil, said inner cutter assembly being driven within said mount frame to reciprocate along said longitudinal axis for shearing hairs between said shearing foil and said inner blades, said inner cutter assembly being mounted to be movable to a limited extent within said mount frame transversely towards said side bars;

said shearing foil having its lateral lower end portions secured to the exterior surface of said side bars, respectively, such that the lower end portions of said shearing foil are isolated from said inner cutter assembly by the side bars so as not to be in direct contactable relation with the inner cutter assembly, wherein said mount frame includes a pair of elongated clamp plates each of which is placed over the lower end portion of said shearing foil and fixed onto the exterior surface of said side bar to hold said lower end portion of said shearing foil therebetween, each of said clamp plates having its top portion extending above the top edge of the adjacent side bars along the curved surface of said shearing foil to conceal said apertures in a limited region adjacent upwardly of said side bar.

2. In a cutting head for reciprocatory-type shavers comprising:

a mount frame having a pair of opposed side bars between which a shearing foil extends in a convexly curved manner, said curved shearing foil having a plurality of hair receiving apertures and having a longitudinal axis extending along its top end in parallel with said side bars;

an inner cutter assembly having a plurality of inner blades which are in shearing contact with the undersurface of said shearing foil, said inner cutter assembly being driven within said mount frame to reciprocate along said longitudinal axis for shearing hairs between said shearing foil and said inner blades, said inner cutter assembly being mounted to be movable to a limited extent within said mount frame transversely towards said side bars;

said shearing foil having its lateral lower end portions secured to the exterior surface of said side bars, respectively, such that the lower end portions of said shearing foil are isolated from said inner cutter assembly by the side bars so as not to be in direct contactable relation with the inner cutter assembly, wherein said mount frame includes a pair of elongated clamp plates each of which is placed over the lower end portion of said shearing foil and fixed onto the exterior surface of said side bars to hold said lower end portion of said shearing foil therebetween, each of said bars being formed on its exterior surface with a set of studs which extend through mount holes correspondingly formed in the lower end portions of said shearing foil, each of said clamp plate having on its inner surface a longitudinally extending groove for receiving the heads of said studs, said groove being formed on its outer surface with a corresponding rib for reinforcement of said clamp plate.

3. A cutting head as set forth in claim 1, wherein said mount frame is detachably supported on an auxiliary frame which is also detachably secured to a main shaver housing incorporating source means for driving said inner cutter assembly.

4. A cutting head as set forth in claim 1, wherein said mount frame is detachably mounted on the top of a main shaver housing of a flat configuration having a front face and a rear face, said main shaver housing incorporating therein source means for driving said inner cutter assembly and having on its front face a handle for energizing and deenergizing said source means;

said shearing foil having an apex end which is offset laterally such that one half of the face of said convexly curved shearing foil is substantially in the same general plane as the front fact of said main shaver housing.

5. A cutting head as set in claim 2 wherein said shearing foil is made to have less rigidity at the top end portion of the curved configuration than at the other portions.

6. A cutting head as set forth in claim 2, wherein said mount frame is detachably supported on an auxiliary frame which is also detachably secured to a main shaver housing incorporating source means for driving said inner cutter assembly.

7. A cutting head as set forth in claim 2, wherein said mount frame is detachably mounted on the top of a main shaver housing of a flat configuration having a front face and a rear face, said main shaver housing incorporating therein source means for driving said inner cutter assembly and having on its front face a handle for energizing and deenergizing said source means;

said shearing foil having an apex end which is offset laterally such that one half of the face of said convexly curved shearing foil is substantially in the same general plane as the front fact of said main shaver housing.

8. A cutting head as set forth in claim 2, wherein said shearing foil is made to have less rigidity at the top end portion of the curved configuration than at the other portions.

9. A cutting head as set forth in claim 1, wherein the clamp plate is held in intimate contact with the shearing foil along its top edge.

* * * * *